United States Patent [19]

Schwartz et al.

[11] Patent Number: 4,826,508

[45] Date of Patent: May 2, 1989

[54] FLEXIBLE ABRASIVE COATED ARTICLE AND METHOD OF MAKING IT

[75] Inventors: Alexander Schwartz; Joseph Lazar, both of Montreal; Semyon Lvovich, Brossard, all of Canada

[73] Assignee: Diabrasive International, Ltd., Quebec, Canada

[21] Appl. No.: 94,809

[22] Filed: Sep. 10, 1987

[30] Foreign Application Priority Data

Sep. 15, 1986 [CA] Canada ..... 518201
Feb. 27, 1987 [CA] Canada ..... 530811

[51] Int. Cl.[4] ..... B24D 3/00

[52] U.S. Cl. ..... 51/293; 51/295; 51/298; 51/309

[58] Field of Search ..... 51/293, 295, 298, 309

[56] References Cited

U.S. PATENT DOCUMENTS

| | | | |
|---|---|---|---|
| Re. 30,494 | 3/1981 | Gorsuch | 51/309 |
| 2,820,746 | 1/1958 | Keeleric | 204/16 |
| 3,517,464 | 6/1970 | Mattia et al. | 51/293 |
| 3,759,799 | 9/1973 | Reinke | 51/295 |
| 3,762,895 | 10/1973 | Keeleric | 51/293 |
| 3,860,400 | 1/1975 | Prowse et al. | 51/295 |
| 4,047,902 | 9/1977 | Wiand | 51/295 |
| 4,163,647 | 8/1979 | Swiatek | 51/295 |
| 4,256,467 | 3/1981 | Gorsuch | 51/295 |
| 4,317,660 | 3/1982 | Kramis et al. | 51/295 |

FOREIGN PATENT DOCUMENTS

| | | |
|---|---|---|
| 1049790 | 3/1979 | Canada . |
| 013486 | 7/1980 | European Pat. Off. . |
| 57-138577 | 8/1982 | Japan . |
| 57-39163 | 8/1982 | Japan . |
| 58-45872 | 3/1983 | Japan . |
| 61-50773 | 3/1986 | Japan . |
| 61-271070 | 10/1986 | Japan . |
| 61-265276 | 11/1986 | Japan . |
| 61-277904 | 12/1986 | Japan . |
| 1498689 | 1/1978 | United Kingdom . |
| 2068275 | 8/1981 | United Kingdom . |

*Primary Examiner*—Paul Lieberman
*Assistant Examiner*—Willie J. Thompson
*Attorney, Agent, or Firm*—Larson and Taylor

[57] ABSTRACT

In the production of an abrasive member, an apertured mask, preferably formed of a resin such as polyvinyl chloride, is applied to one surface of a length of flexible, preferably electrically conducting fabric. A metal, such as nickel, is electrolytically deposited on the fabric through the apertures in the mask in the presence of abrasive particles. The fabric may be in the form of a conductive mesh, in which case it can be laminated onto a tough backing material. Alternatively, tough backing material, for example made of poly-aramid yarn, can be rendered conductive by coating it with vaporized metal, the metal deposits being formed directly in the coated backing fabric. This process simplifies manufacture and allows production on a continuous basis with greater throughput at lower cost.

61 Claims, 3 Drawing Sheets

FLEXIBLE ABRASIVE COATED ARTICLE AND METHOD OF MAKING IT

The present invention relates to abrasive members and in particular to flexible abrasive members incorporating abrasive particles. Such abrasive members are useful in grinding, smoothing and other operations on glass, stone, or other materials, and in particular for use as industrial abrasives as a longer-lasting alternative to conventional sanding products.

U.S. Pat. No. 4,256,467 issued Aug. 17, 1981 to Ian Gorsuch, discloses a flexible abrasive member comprising a flexible non-electrically conductive mesh material and a layer of electrodeposited metal adhering directly to and extending through the mesh material so that the mesh material is embedded in the metal layer. Abrasive material is embedded in the metal layer.

According to this U.S. patent the flexible abrasive member is manufactured by first laying a length of flexible non-electrically mesh material onto a conductive surface so that the mesh material is in immovable relationship with the conductive surface. A layer of metal is then electrodeposited onto the smooth surface through the mesh material in the presence of abrasive material so that the abrasive material becomes embedded in the metal layer and the metal layer adheres to the mesh. Finally, the mesh and the associated metal layer with the embedded abrasive material are stripped from the electrically conductive surface to constitute the abrasive member.

In this process the electrically conductive smooth surface is formed by a cylinder of stainless steel. The mesh material is attached under tension to the surface of the cylinder. An essential feature of the process is that there is no relative movement between the cylinder surface and the mesh so as to prevent build-up of metal on the cylinder underneath the mesh.

The cylinder is prepared by a relatively complex procedure, which involves applying an electrically insulating acid photo resist to the stainless steel cylinder in the desired pattern to form a stencil.

Such a process requires substantial capital equipment, and in particular the preparation of the cylinder is expensive and complex. The process is also slow in operation and can only be operated on a batch basis because a length of flexible mesh material of specific size must be attached to the cylinder, applied under tension, and be immovable relative thereto. The whole process will produce only a single flexible abrasive member. After each operation the cylinder must be cleaned, and this is difficult to do without damaging the stencil. The product made by the Gorsuch process is structurally weak and generally suited for specialized application, such as grinding lenses, rather than more general industrial application.

An object of the invention is to alleviate the aforementioned problem of the prior art.

According to the present invention there is provided a method of forming a flexible abrasive member, comprising providing a length of flexible fabric, applying a flexible mask of non-electrically conductive material having a multitude of discrete openings therein to one surface of said flexible fabric, placing the fabric with the mask applied thereto in a metal deposition bath, and depositing metal directly in said discrete openings onto said flexible fabric in the presence of particulate abrasive material such that the metal adheres directly to the fabric to form metal deposits in said openings and the abrasive material becomes embedded in the metal deposits.

The deposition preferably takes place by electrodeposition and the discrete openings are preferably arranged in the form of a lattice.

The fabric may be in the form of a mesh. In a process according to the invention, the stainless steel cylinder may be eliminated when an electrically conductive flexible mesh is used.

In a preferred embodiment the electrically conductive cylinder is not required and the method can be operated on a continuous basis to produce a flexible abrasive member at a much higher rate and much lower cost than in the process according to the U.S. Patent.

It has, in particular, been found according to the present invention that by laminating to an electrically conductive flexible mesh a mask of non-conductive electrical material defining a multitude of discrete openings for the electrodeposition of metal containing the abrasive material in each of the openings, it is possible to avoid the use of a cylinder with tensioning because close contact of the mesh material with the cylinder is unnecessary. The process is no longer limited to batch operation with a particular size of mesh material.

In a preferred embodiment the length of flexible mesh material is in the form of a wire mesh, e.g. a fine wire mesh, or metallized polyester resin mesh supplied under the trademark metalin MP E260 by B and SH Thompson Co. Ltd.

The length of the flexible material may also be a flexible polymer resin mesh, such a polyester resin mesh, laminated on the side remote from the mask to a metal foil. The metal foil can be easily removed after electrodeposition.

By first forming the mask on the electrically conductive mesh material rather than on the electrically conductive surface, i.e. the surface of a cylinder, it is possible to operate the process by continuously passing the laminate through an electrodeposition bath, e.g. an electrolytic bath, where the length of flexible mesh material forms the cathode and metal to be deposited forms the anode.

In a particularly preferred embodiment of the present invention the mask is in the form of a very thin sheet, suitably a few thousandths, e.g. 3–4 thousandths of an inch thick, of a polymer resin, such as polyvinyl chloride. Such a mask defines a lattice with a large number of openings of, for example of 1/16" diameter. Lamination takes place under heat and pressure.

The abrasive material is a conventional abrasive such as diamond or cubic boron nitride, and in particular industrial diamond. The metal can be any metal which can be deposited from a suitable bath by electrodepositing or electroless plating, and is preferably nickel or copper, more preferably nickel.

In a preferred embodiment of the method of the present invention the length of electrically conductive flexible mesh material is continuously passed through an electrolytic bath to form a cathode, the anodes of which are formed by said metal, whereby the metal is continuously deposited in the discrete openings and the particulate abrasive during said electrodeposition is released into said bath. In order to ensure that the length of flexible mesh material is present in the bath as a cathode, it is connected to a source of negative potential. The mesh material is preferably in contact with a smooth non-conductive surface, such as a plastic surface in the bath, which is suitably a nickel sulfamate bath.

When the fabric is in the form of a mesh, it is generally laminated onto a backing fabric for strength. An abrasive member reinforced in this way can be made into a sanding belt and similar abrasive articles. Preferably the backing fabric comprises a woven polyaramid fabric.

The invention also provides a flexible abrasive member comprising a length of flexible fabric having applied to one surface thereof an electrically non-conductive mask layer having a multitude of discrete openings therein, and deposited metal adhering to said fabric in each of the openings, said deposited metal having particulate abrasive material embedded therein.

Preferably, the fabric is made of poly-p-phenyleneterephthalamide.

A laminated abrasive member of this construction has been shown to have remarkable properties of longevity and strength. Such a member can even be used to cut edge on into glass, particularly if the backing material is coated on its underside with polyurethane adhesive.

The flexible fabric can also be rendered at least partially conductive, with the metal being deposited directly on the fabric, using the conductive portion as an electrode, particulate abrasive material being embedded in the metal deposits during the formation thereof.

A backing fabric can be coated with a vaporized metal such that the vaporized metal becomes firmly attached to the fabric to provide a conductive coating, the conductive coating masked to expose only the discrete locations, and the metal deposited on the coating at the discrete locations, using said coating as an electrode, in the presence of abrasive particles such that said particles become embedded therein.

The above described method permits the complete elimination of the lamination stage and the fabrication of an abrasive belt directly onto the backing fabric. The backing fabric is preferably made of polyaramid yarn, such as p-poly(phenylene) terephthalamide and sold by Dupont under the trademark Kevlar.

The fabric is preferably made of scoured 1500 denier yarn having a balanced weave.

The invention will now be described in more detail, by way of example only, with reference to the accompanying drawings in which:

FIG. 1 is a schematic diagram showing the continuous production of an abrasive member in accordance with an embodiment of the present invention;

FIG. 1*a* is a detail of the laminate before it enters the electrolytic bath in FIG. 1;

FIG. 1*b* is a detail of the abrasive member as it leaves the electrolytic bath in FIG. 1;

Figures 1, 1A, 1B:
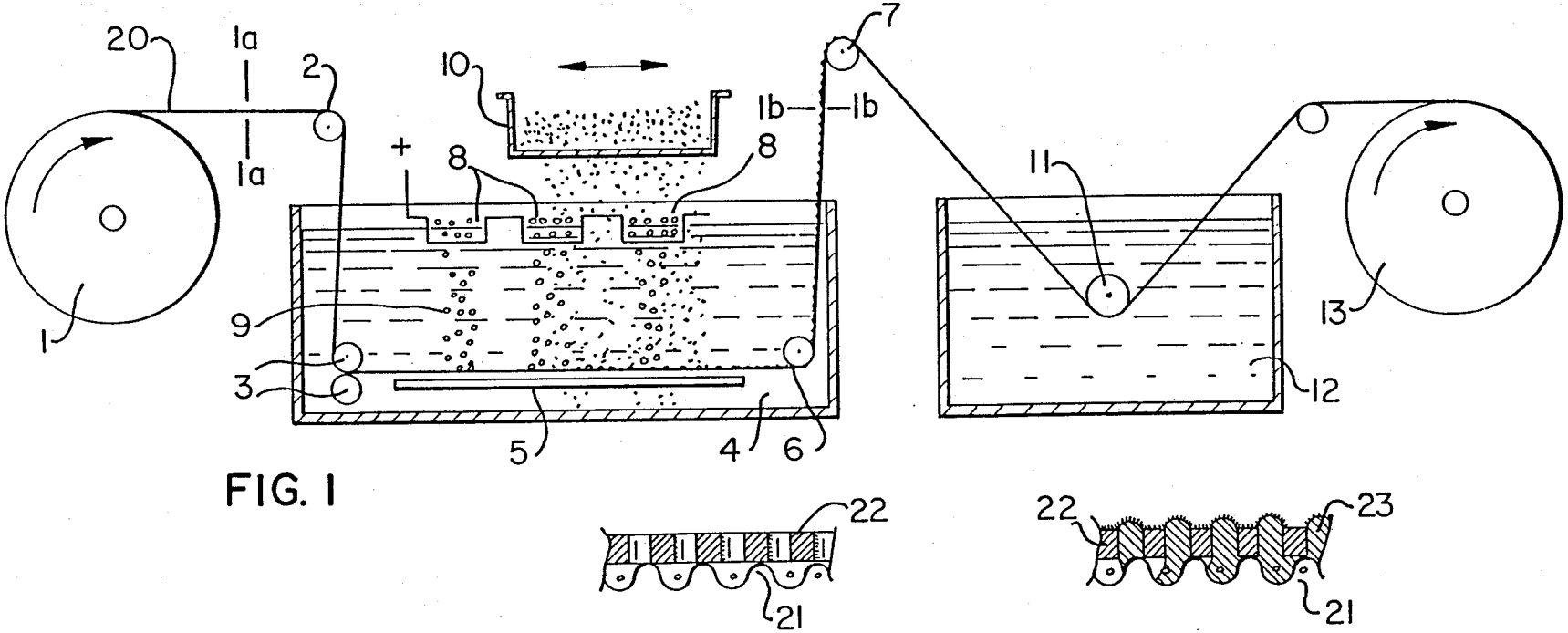

Referring to the drawings, a laminate 20 comprising an electrically conductive flexible mesh material 21, such as a fine wire mesh material or a metallized polyester resin mesh supplied under the trademark METALIN MPE 260, and a polyvinyl chloride resin mask 22 having lattice of discrete openings distributed uniformly therein, is passed over idler roll 2 and between idler rolls 3 in a electrolytic nickel bath 4. In the bath 4 the laminate 20 passes over the smooth non-electrically conductive upper surface of a plastic plate 5 and then out of the bath over idler rolls 6 and 7.

The idler roll 2 is maintained at negative potential from an external source and thus makes the flexible laminate 20 passing over the smooth plastic plate 5 the cathode. The passage of the laminate 20 across the smooth member 5 is such that the mask 22 is uppermost. The plastic plate can also be in the form of a drum, with the laminate extending around part of its periphery.

The electrolytic bath 4 is also provided with a plurality of titanium baskets 8 containing nickel turnings. The baskets are connected from an external source to a positive potential and thus form anodes. During passage of the laminate 20 over the member 5, electrodeposition of nickel occurs in the discrete openings of the mask 22, forming in the openings deposits of nickel which intimately adhere to the mesh 21.

During the passage of the laminate 20 over the smooth member 5 during the formation of the metal layer, particles of abrasive material 9 are shaken into the bath 4 from a shaker device 10 and become embedded in the metal deposits to form pellets 23 containing the abrasive.

From the idler roller 7 the laminate 20 is passed under idler roller 11 into a washing bath 12 where it is rinsed with water and passed to a collecting roll 13 for the continuous flexible abrasive member.

The present invention will be further illustrated by way of the following example.

EXAMPLE

The electrolytic bath is a commercial nickel sulfamate bath supplied under the trademark SNR 24 by Henson Inc., operated at a 170 amps and 9 volts d.c. and at a temperature of 140°. The laminate is passed through the bath at the rate of 2 inches/minute.

The laminate consists of a fine nickel or stainless steel silk screen mesh supplied under the trademark METALIN MPE 260 by B. & S. E. Thompson and Co. Ltd. The mask is made of polyvinyl chloride and has symmetrically disposed therein a lattice of a large number of openings (90/square inch) of about 1/16" in diameter. The mask has a thickness of ¾ thousandths of an inch and is laminated to the mesh from silicone release paper under heat and pressure at 350° F. and 85 psi.

The flexible abrasive member taken from the roll 13 is suitable for use. It may be bonded to a heavy polyester cloth, suitably supplied by Carborundum under the trademark NRE 5206. For its use as an abrasive the member may be attached to various substrates.

Figure 2:
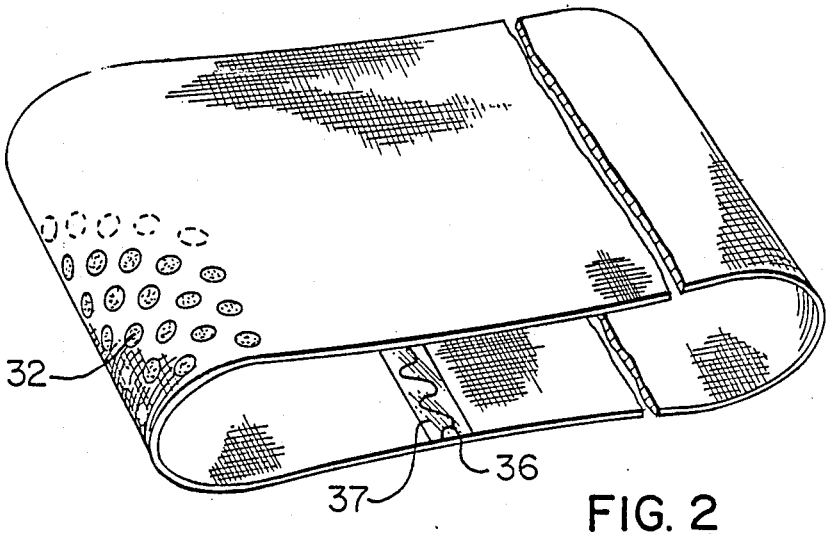
FIG. 2 is a perspective view of a sanding belt comprising an abrasive member in accordance with the invention, with only some of the metal deposits illustrated.
Figure 3:
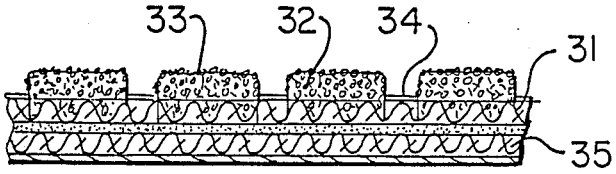
FIG. 3 is a cross-section through a part of the sanding belt shown in FIG. 1.

Referring now to FIGS. 2 and 3, the sanding belt comprises a flexible fine conductive mesh 31, for example a mesh supplied under the trade mark METALIN MP E260 by B & S. H. Thompson Co., Ltd., bearing a multitude of discrete island nickel deposits 32 in which the mesh 31 is embedded. The deposits 32 are formed by electrodeposition according to the process described above. Abrasive particulate material 33, for example diamond particles, is embedded in the nickel deposits 32 during the electrodeposition process. Although it is preferred that the mesh 31 be conductive, it is possible to employ a non-conductive mesh, with a mask applied thereto, in which the mesh should be placed on a conductive surface. If a conductive mesh is employed, the mesh has a polyvinyl chloride mask 34 defining the openings through which the electrodeposits are formed on its top surface.

The mesh 31 is laminated onto a backing fabric 35 of 1500 denier Kevlar fabric (a trade mark for a yarn made from poly-p-phenyleneterephthalamide). This fabric is used for such applications as bullet proof vest and is sold by Barrday Inc. of Cambridge, Ontario under the trade designation 2160/175 F SC.

Prior to lamination, the fabric is coated on both sides with a polyurethane sealant adhesive, such as Bostik 7070 TM. Once the adhesive has dried, the mesh 31 bearing the metal deposits 32 is laminated onto the coated fabric with the same adhesive, preferably under heat and pressure.

In order to form a sanding belt, the laminated material is cut into strips and the ends cut in a interlocking wavy fashion as shown at 36 in FIG. 2. The two ends are joined together by means of a Mylar TM strip 37 applied by means of the same Bostik 7070 adhesive.

Such a sanding belt has remarkable longevity and strength properties. It will last many times longer than a conventional sanding belt.

In some applications it may be desirable to laminate the flexible mesh 31 on both sides of the fabric 35. This sandwich construction is so strong that it can surprisingly cut edgewise into glass. The central fabric can be made quite rigid if the abrasive member is used as a cutting tool in this manner.

The composite abrasive member, including the flexible mesh 31 bearing the nickel deposits 32 and the backing fabric 35, possibly with a flexible mesh 31 on both surfaces, can be conveniently formed into other articles, such as abrasive disks, pads and the like.

Figure 4:
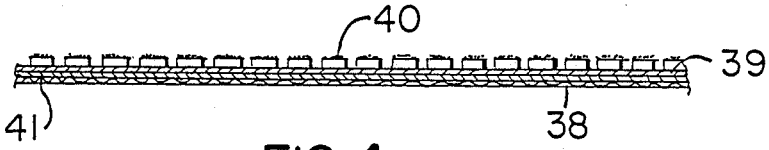
FIG. 4 shows an alternative embodiment of an abrasive member in accordance with the invention.
Figure 5:
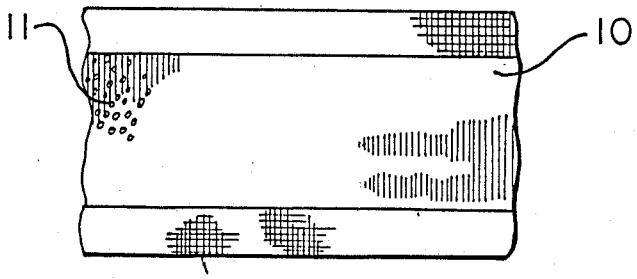
FIG. 5 is a plan view of the abrasive member shown in FIG. 4.

In an alternative embodiment, the abrasive member is formed directly onto the backing fabric, which is used as a substrate. In FIG. 4 the backing fabric 38 is made of 1500 denier Kevlar TM fabric of the same trade designation as the fabric referred to above. A metal foil 39 is laminated onto the Kevlar fabric 38 with a polyurethane adhesive, such as Bostik 7070 TM. A polyvinyl chloride mask 40 with a multitude of small openings forming a lattice is then laminated onto the metal foil 39. Nickel deposits 41 are then electrodeposited through the openings onto the metal foil, with the particulate diamond abrasive material being embedded in the nickel deposits. The polyvinyl chloride mask 40 can also be replaced by a second layer of a Kevlar fabric defining the openings, with which the backing material 38 and film 39 forms a strong sandwich construction.

Alternatively the metal foil 39 can be laminated on the underside of the backing fabric 38, which may have a looser weave to allow the fabric yarns to become embedded in the nickel deposits.

In a still further embodiment the metal foil 39 can be replaced by a layer of metal that is deposited by vapour deposition onto either the front or rear surface of the backing fabric 38.

In another embodiment the metal layer is formed onto a Mylar TM supporting sheet.

Figure 6:
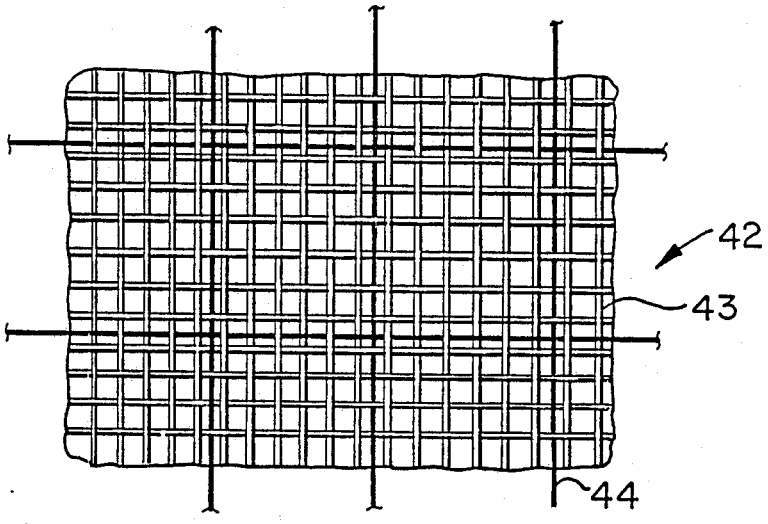
FIG. 6 is a plan view of a fabric forming a further embodiment according to the present invention.

In the embodiment shown in FIG. 6 the backing fabric 42 comprises a fabric woven from yarns 43 of the same 1500 denier Kevlar TM and conductive yarns, preferably wires, 44 shown by broken lines. As shown the conductive yarns are interwoven in both the warp and weft directions every seven threads. The conductive yarns can be woven in the fabric in only one direction and can be woven in different groupings. For example, the non-conductive and conductive yarns could alternate or the conductive yarns can be arranged in groups of two or more.

The whole fabric can then be placed in a commercial nickel sulfamate bath, for example the bath described above. The conductive wires are made the cathode and nickel deposits form around the conductive wires and adjacent non-conductive yarns where the former are exposed. Particulate diamond abrasive can be sprinkled into the bath and embedded in the forming nickel deposits in the same manner as described above.

The partially conductive fabric described in FIG. 6 enables the abrasive member to be formed directly onto the backing material without the need for the intermediate lamination step.

Though the fabric is preferably made of Kevlar yarn, other yarns, such as polyester can be employed for certain applications.

In a still further embodiment, the wires 44 can have a non-conductive coating. In this case the wires are generally woven closer together, for example alternating with the non-conductive yarns. In order to define the areas where nickel deposits are to be located, the non-conductive coating can be removed by chemical etching or radiation, for example, with infrared radiation. For this purpose a rigid mask having a multitude of holes is laid over the fabric to expose only those portions where nickel deposits are desired. The chemical etchant or radiation is applied to the mask to remove the non-conductive coating from the wires at these locations. When the fabric is immersed in the nickel plating bath, the nickel deposits are only formed at locations where the non-conductive coating has been removed.

Alternatively, if the wires 44 do not have a non-conductive coating, the fabric can be plated through a rigid plastic mask, which is subsequently removed or in the alternative a chemical mask, such as a polyvinyl chloride mask, can be applied to the fabric.

Figure 7:
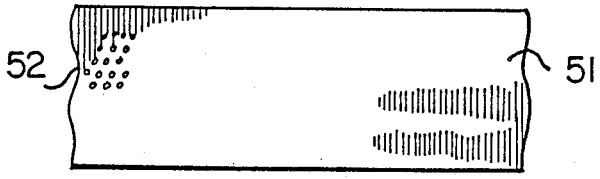
FIG. 7 is a plan view of a section of fabric bearing nickel deposits.
Figure 8:
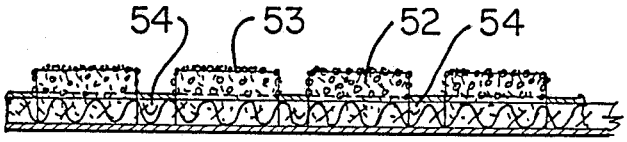
FIG. 8 is a cross-section of a small length of fabric shown in FIG. 7.

Referring now to FIG. 7, which shows a strip of Kevlar fabric 51 (Kevlar is a trade mark of Dupont for P-poly(phenylene terephthalamide) yarn having deposited thereon, at discrete locations and in a uniform pattern, roughly circular deposits 52 of nickel, the deposits bearing abrasive particles formed of diamond grit. The deposits 52 can be seen more clearly in FIG. 8, which shows in enlarged cross-section, a small length of the fabric shown in FIG. 1. The diamond particles are referenced 53.

The nickel deposits 52 are formed on a vaporized copper coating 54 firmly attached to the Kevlar fabric.

The strip of Kevlar fabric is folded over to form a belt, with the two ends being lap jointed along a wavy line and held together by means of an overlying adhesive strip in a similar manner to the laminated belt shown in FIG. 2.

The nickel deposits 53 are formed, by means of the copper coating 4, directly onto the Kevlar backing fabric.

The abrasive belt is made from a Barrday F-2160/175 Kevlar 29-1500 denier secured fabric. The fabric is then coated with a layer of vaporized copper, which has good compatibility with nickel in the electrodeposition process. The copper should be firmly attached to the fibers making up the Kevlar fabric. This is achieved by spraying the vaporized copper onto the Kevlar fabric with a Metco type 12 4-arc all purpose metallizing spray gun. The arc spray gun forms an arc between a pair of copper electrodes and blows the vaporized copper onto the fabric by means of an air jet.

With this technique, approximately one square foot of fabric can be coated to a thickness of 2 mils in 10 seconds. To ensure good penetration, the fabric should be stretched out on a flat surface and the arc spray gun uniformly moved over the fabric.

Other techniques for coating the fabric have also been successful. A less coarse deposit can be achieved with the Metco nova advanced plasma gun, and it is also possible to use a copper wire vaporized by means of an oxy-acetylene flame. The latter technique, however leads to a coarser deposit, which in turn can render the subsequent masking step, to be described, more difficult. Other techniques, such as vacuum deposition, electroless deposition, spraying, and painting can be employed to coat the fabric with a conductive surface, but the preferred technique for adhesion, fineness, and uniformity of attachment is the arc spray gun.

When a suitable copper coating has been built up on the Kevlar fabric, with good penetration of the copper into the fabric fibres, a mask, such as a polyvinyl chloride mask, having symmetrically disposed therein a very large number of holes (approximately 90 per square inch) of about 1/16 inch in diameter, and the mask being of a thickness of about ¾ of thousandth of an inch, is applied to the copper coating. The mask can be laminated to the mesh from a silicone release paper, under a heat and pressure at 350 degress F. and 85 PSI. The mask is first formed on the silicone release paper by a silk screen or other suitable process. The mask is preferably applied to the silicone release paper in the form of a plastisol.

Once the mask has been applied to the copper coated Kevlar fabric, the laminate is then placed in an electrolytic tank, for example the commercial nickel sulfamate bath described above. Nickel deposits build up on the portions of the copper coating exposed through the holes in the mask. During the build up of nickel, the abrasive diamond particles are distributed over the fabric so as to become firmly embedded in the nickel deposits in a similar manner to the previous embodiments.

The electrodeposition process can be carried out in a manner similar to the process described in the example with the coated Kevlar fabric in effect taking the place of the conductive mesh.

It is because the mask has to be applied to the copper coating that the coarseness of the coating is important. As mentioned above, the arc spray gives a reasonably uniform coating, in which the mask can be attached. If the coating is too coarse, the coarse particles will tend to penetrate the mask causing nickel to be deposited on them at unwanted locations during the deposition process.

The treated fabric, when it emerges from the bath, can be cut to size and is ready for used as an abrasive without the need to have it laminated onto a backing material. The Kevlar fabric is extremely strong and well suited to most industrial applications.

The fabric is preferably coated on the back with an adhesive, such as Bostik 7070 adhesive, to reduce fraying at the edges. The two ends are preferably joined together in a wavy lap joint, as illustrated in FIG. 1, and overlaid on the inside with a strip of fabric. The same Bostik 7070 adhesive can be employed.

In order to increase the strength of the belt further, the strip can be stitched to the fabric with Kevlar thread.

We claim:

1. A method of making a flexible abrasive member, comprising providing a length of flexible fabric that has been treated to render it conductive, applying a flexible mask of non-electrically conductive material having a multitude of discrete openings therein to one surface of said conductive flexible fabric, placing the fabric with the mask applied thereto in an electrolytic bath such that the conductive fabric becomes the cathode thereof, and electrodepositing metal directly in said discrete openings onto said conductive flexible fabric in the presence of particulate abrasive material to form metal electrodeposits on said conductive fabric in said openings with the particulate abrasive material embedded in said electrodeposits.

2. A method as claimed in claim 1, in which said fabric is rendered conductive by the application of a metal layer to one surface thereof.

3. A method as claimed in claim 2, in which the mask comprises a lattice defining said multitude of openings.

4. A method as claimed in claim 2, in which the flexible fabric is a mesh.

5. A method as claimed in claim 4, in which the flexible fabric is in the form of a metallized resin mesh.

6. A method as claimed in claim 4, in which the flexible fabric comprises a polymer resin mesh laminated to a metal foil.

7. A method as claimed in claim 2, in which the mask is formed of polymeric resin laminated to said flexible fabric under heat and pressure.

8. A method as claimed in claim 7, in which the polymeric resin is polyvinyl chloride.

9. A method as claimed in claim 1, in which the flexible fabric is continuously passed through said electrolytic bath and the anodes of said bath are formed of said electrodeposited metal, whereby said metal is continuously deposited in the discrete openings during the passage of said fabric though said bath and the abrasive material is released in said bath during said electrodeposition to become embedded in said metal deposits.

10. A method as claimed in claim 2, in which the electrodeposit metal is nickel.

11. A method as claimed in claim 2, in which the particulate abrasive material is diamond.

12. A method as claimed in claim 4 in which the mesh is a polyester mesh.

13. A method as claimed in claim 5, in which the mesh is a metallized polyester resin mesh.

14. A method as claimed in claim 2 wherein said fabric is a tough backing material.

15. A method as claimed in claim 2 wherein said flexible fabric is rendered conductive by coating it with a vaporized metal such that the vaporized metal becomes firmly attached to the fabric to provide a conductive coating, said mask is applied to said conductive coating to expose only said discrete locations, and said metal is electrodeposited on said coating at said discrete locations in the presence of said particulate abrasive material such that said particulate abrasive material becomes embedded in said metal electrodeposits.

16. A method as claimed in claim 15 wherein said vaporized metal is sprayed onto said fabric.

17. A method as claimed in claim 16 wherein said vaporized metal is sprayed with an arc spray gun.

18. A method as claimed in claim 16 wherein said vaporized metal is sprayed with a plasma spray gun.

19. A method as claimed in claim 16 wherein said electrodeposited metal is nickel and said vaporized metal is copper.

20. A method as claimed in claim 15 wherein said fabric is made of a scoured polyaramid yarn.

21. A method as claimed in claim 20 wherein the yarn is made of poly(p-phenylene terephthalamide) fibre.

22. A method as claimed in claim 21 wherein the fabric is about 1500 denier.

23. A method as claimed in claim 15 wherein the mask is a plastisol mask applied by a silk screen process.

24. A method as claimed in claim 4 wherein said mesh bearing said metal deposits is subsequently laminated to a backing sheet comprising a woven fabric of a polyaramid yarn.

25. A method as claimed in claim 24 wherein the yarn is made of poly-p-phenyleneterephthalamide.

26. A method as claimed in claim 25 wherein said flexible fabric is laminated to said backing sheet with polyurethane adhesive.

27. A method as claimed in claim 26 wherein said fabric is made of yarn of about 1500 denier.

28. A method as claimed in claim 24, wherein said backing sheet is coated on both sides with polyurethane adhesive.

29. A method as claimed in claim 1 wherein said flexible fabric is rendered conductive by means of wires interwoven with non-conductive yarn.

30. A method as claimed in claim 29 wherein said wires are coated with non-conductive material except where said deposits are to be formed.

31. A method as claimed in claim 29 wherein said wires are completely coated with non-conductive material, and said non-conductive material is removed from the wires woven into the fabric at locations where said deposits are required prior to electrodeposition.

32. A method as claimed in claim 31 wherein said non-conductive material is removed by chemical etching through a mask.

33. A method as claimed in claim 31 wherein said non-conductive material is removed by irradiation through a mask.

34. A method as claimed in claim 2 wherein said metal layer comprises a metal foil laminated onto said one surface.

35. A method as claimed in claim 2 wherein said metal film is deposited by vapour deposition.

36. A method as claimed in claim 34 where said fabric is woven.

37. A method as claimed in claim 36 wherein said woven fabric is made of polyaramid yarn.

38. A method as claimed in claim 36 wherein said yarn is made of poly-p-(phenylene) terephthalamide.

39. A method as claimed in claim 38 wherein said mask also comprises a woven fabric.

40. A method as claimed in claim 39 wherein said woven fabric mask is made of poly-p-(phenylene) terephthalamide.

41. A flexible abrasive member comprising a length of flexible fabric that has been treated to render it conductive, an electrically non-conductive mask layer applied to one surface of said fabric, said non-conductive mask layer having a multitude of discrete openings therein, and electrodeposited metal adhering to said conductive fabric in each of the openings, said electrodeposited metal having particulate abrasive material embedded therein.

42. A member as claimed in claim 41 in which the flexible fabric is rendered conductive by means of a metal layer applied to one surface thereof.

43. A member as claimed in claim 41 in which the flexible fabric is in the form of a metallized resin mesh.

44. A member as claimed in claim 42 in which the metal layer is a metal foil laminated to said flexible fabric.

45. A member as claimed in claim 42 in which the mask is made of polyvinyl chloride.

46. A member as claimed in claim 41, in which the electrodeposited metal is nickel.

47. A member as claimed in claim 42, in which the particulate abrasive material is diamond grit.

48. A member as claimed in claim 44 in which the non-conductive mesh is a polyester mesh.

49. A member as claimed in claim 38 wherein the yarn is made of poly(p-(phenylene terephthalamide).

50. A member as claimed in claim 49 wherein said flexible fabric is laminated to said blocking sheet with polyurethane adhesive.

51. A member as claimed in claim 50 wherein said fabric is made of yarn of about 1500 denier.

52. A member as claimed in claim 38, wherein said backing sheet is coated on both sides with polyurethane adhesive.

53. A member as claimed in claim 38, wherein said particulate abrasive material is diamond.

54. An abrasive member as claimed in claim 38 comprising a coating of vaporized metal deposited on said fabric and firmly attached thereto, and said metal deposits having abrasive particles embedded therein being provided at said discrete locations on said metal coating.

55. An abrasive member as claimed in claim 42 wherein said layer comprises a film of vaporized metal deposited on said fabric and firmly attached thereto, and said metal deposits having abrasive particles embedded therein being provided at discrete locations on said metal layer.

56. An abrasive member as claimed in claim 55 wherein said poly-aramid yarn is poly(p-phenylene terephthalamide).

57. An abrasive member as claimed in claim 54 wherein said metal layer is copper and said metal deposits are nickel.

58. An abrasive member as claimed in claim 54 wherein said abrasive particles are diamond grit.

59. An abrasive member as claimed in claim 54 wherein said fabric formed into a belt.

60. A flexible abrasive member produced by the method as claimed in claim 1.

61. An abrasive belt comprising a flexible abrasive member as claimed in claim 60.

* * * * *